US009696011B2

(12) United States Patent
Grajcar

(10) Patent No.: US 9,696,011 B2
(45) Date of Patent: Jul. 4, 2017

(54) EXTENDED PERSISTENCE AND REDUCED FLICKER LIGHT SOURCES

(75) Inventor: Zdenko Grajcar, Crystal, MN (US)

(73) Assignee: ONCE INNOVATIONS, INC., Plymouth, MN (US)

( * ) Notice: Subject to any disclaimer, the term of this patent is extended or adjusted under 35 U.S.C. 154(b) by 279 days.

(21) Appl. No.: 13/452,332

(22) Filed: Apr. 20, 2012

(65) Prior Publication Data

US 2012/0268918 A1 Oct. 25, 2012

Related U.S. Application Data

(60) Provisional application No. 61/478,472, filed on Apr. 22, 2011.

(51) Int. Cl.

| | |
|---|---|
| ***F21V 9/16*** | (2006.01) |
| ***F21V 3/04*** | (2006.01) |
| ***F21K 9/23*** | (2016.01) |
| ***F21K 9/64*** | (2016.01) |
| *H05B 33/08* | (2006.01) |
| *F21Y 115/10* | (2016.01) |

(52) U.S. Cl.

CPC ..... *F21V 9/16* (2013.01); *F21K 9/23* (2016.08); *F21K 9/64* (2016.08); *F21V 3/0481* (2013.01); *F21Y 2115/10* (2016.08); *H05B 33/0809* (2013.01); *H05B 33/0824* (2013.01)

(58) Field of Classification Search

CPC . F21V 9/16; F21V 3/0481; F21K 9/56; F21K 9/13; H05B 33/0803; F21Y 2101/02

USPC ..... 362/84

See application file for complete search history.

(56) References Cited

U.S. PATENT DOCUMENTS

| | | | | |
|---|---|---|---|---|
| 2006/0164004 | A1 | 7/2006 | Rossner | |
| 2007/0024173 | A1 | 2/2007 | Braune | |
| 2007/0147032 | A1* | 6/2007 | Furukawa et al. | 362/230 |
| 2007/0267976 | A1 | 11/2007 | Bohler et al. | |
| 2008/0185557 | A1 | 8/2008 | Agrawal et al. | |
| 2008/0211421 | A1 | 9/2008 | Lee et al. | |
| 2010/0025700 | A1 | 2/2010 | Jung et al. | |
| 2010/0201284 | A1* | 8/2010 | Kraus | 362/84 |
| 2011/0025951 | A1 | 2/2011 | Jones | |

OTHER PUBLICATIONS

International Preliminary Report on Patentability issued in International Application No. PCT/US2012/034485 dated Oct. 22, 2013.

(Continued)

*Primary Examiner* — Britt D Hanley

(74) *Attorney, Agent, or Firm* — McDermott Will & Emery LLP

(57) ABSTRACT

A light source is provided with extended persistence and reduced flicker characteristics by using a light capacitive filter. In general, a light source can include an illumination source which converts electrical energy into emitted light. The illumination source, however, is generally powered by an AC waveform, and the periodic variations inherent in the AC waveform may cause flicker in the emitted light. To reduce the flicker, a light capacitive filter is included in the light source to filter the light emitted by the illumination source and produce a light output with reduced flicker. In some examples, the light capacitive filter includes a medium persistence phosphor having a decay constant (or half-life) of between 1 milliseconds and 2 seconds.

8 Claims, 7 Drawing Sheets

(56) References Cited

OTHER PUBLICATIONS

International Search Report and Written Opinion of the International Searching Authority issued in International Application PCT/US 12/34485 dated Jul. 30, 2012.
Jia, D., et al., "Long persistent light emitting diode", Journal of Applied Physics, 2006, vol. 100, pp. 113125-1 to 113125-6, American Institute of Physics.
"Color Change Technology", Performance Indicator product literature, Retrieved from the Internet on Apr. 20, 2012, 2 pages, URL: http://www.performanceindicator.com/.
"Phosphors", Stanford Materials product literature, Retrieved from the Internet on Apr. 20, 2012, 2 pages, Stanford Materials, USA.
"Reference Information about Long Persistence Phosphor Applications", Stanford Materials product literature, Retrieved from the Internet on Apr. 20, 2012, 4 pages, Stanford Materials, USA.

* cited by examiner

EXTENDED PERSISTENCE AND REDUCED FLICKER LIGHT SOURCES

CROSS-REFERENCE TO RELATED APPLICATION

This application claims the benefit of priority from U.S. Provisional Application No. 61/478,472, filed on Apr. 22, 2011, which is hereby incorporated by reference herein in its entirety.

TECHNICAL FIELD

The present subject matter relates to techniques and equipment to reduce flicker and extended light persistence in electrically excited light sources, such as light sources excited by time-varying waveforms.

BACKGROUND

Electrically powered light sources predominantly run off of the electrical grid, and are therefore powered by time-varying electrical signals, such as periodic waveforms of alternating current and voltage polarities, which are generally referred to as alternating current (AC) waveforms. The AC waveforms are generally periodic waveforms having a fundamental frequency. For example, the AC waveforms may have standard frequencies of approximately 50 Hz or approximately 60 Hz depending on the country in which and the electrical grid on which the waveforms are distributed.

The electrically powered light sources convert the electrical energy received from the electrical grid into light energy in order to provide artificial illumination. Because the electrical signal (and associated electrical energy) received by the light source from the electrical grid is time-varying, the light energy output by the light source can also be time-varying. Certain types of electrically powered light sources may thus provide lighting having a time-varying lighting intensity. The variations in lighting intensity, referred to as flicker, can have a frequency related to the standard frequency of the electrical/power signal, such as a frequency of about 50 Hz or about 60 Hz.

The amount flicker produced by a light source may be a function of the type of light source, of the frequency of the electrical/power signal, as well as of the amplitude of the electrical/power signal. For example, in situations in which the electrical excitation signal received by a light source is modulated by a dimmer switch, the flicker of the light output by the light source may increase as the amplitude of the excitation signal (and the corresponding amplitude of the lighting intensity) is reduced.

In order to reduce the flicker in the intensity of light produced by light sources powered by AC waveforms, a need exists for medium persistence light sources that reduce the amount or intensity of the flicker.

SUMMARY

The teachings herein alleviate one or more of the above noted problems by providing light and illumination sources having reduced flicker and extended persistence.

In one example, an illumination module for providing reduced flicker illumination is provided. The illumination module includes an illumination source for converting electrical energy into emitted light, and a light capacitive filter for filtering the light emitted by the illumination source to produce the reduced flicker illumination provided by the illumination module. The light emitted by the illumination source has a first percent flicker, and the reduced flicker illumination provided by the light capacitive filter has a percent flicker that is lower than the first percent flicker. The light capacitive filter may absorb light emitted by the illumination source, and re-emit the absorbed light during a period of time with a half-life of between 1 millisecond and 2 seconds. The illumination source may include a plurality of light emitting diodes (LEDs), and the light capacitive filter may include a coating of a light persistent phosphor.

In another example, a light having extended persistence is provided. The light includes an illumination source for producing light by converting electrical energy into produced light, and a light persistent filter for absorbing light produced by the illumination source and re-emitting the absorbed light during a period of time when the illumination source does not produce light. The light persistent filter re-emits the absorbed light with a half-life of between 1 millisecond and 2 seconds. The illumination source may not produce light during a portion of each cycle of an electrical waveform providing the electrical energy, and the light persistent filter may re-emit absorbed light during the portion of each cycle of the electrical waveform during which no light is produced by the illumination source.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various systems disclosed herein relate to light sources providing extended light persistence and/or reduced flicker, such that the light sources continue to emit light during periods of time when an electrical signal does not provide sufficient electrical energy to the light source for the light source to produce light from the electrical signal.

Reference now is made in detail to the examples illustrated in the accompanying drawings and discussed below.

Figure 1:
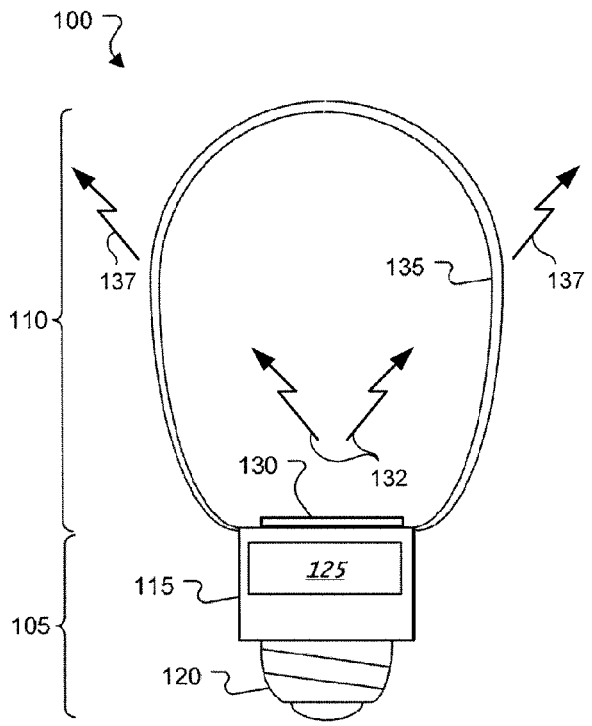
FIG. 1 shows an exemplary light source including a light capacitive filter used to reduce light intensity modulation when the light source is powered by a time-varying waveform.

FIG. 1 shows an illustrative light source including a light capacitive filter used to reduce light intensity modulation (e.g., flicker) when the light source is excited by a time-varying waveform. As shown, an exemplary light source assembly 100 emits light through a light capacitive filter (LCF) disposed in the illumination path. In the example shown in FIG. 1, the light source assembly 100 is formed generally as an A-type lamp with a base module 105 that supports an illumination module 110. The base module 105 provides an electrical interface to receive, process, and supply electrical energy from electrical contacts 120 to the illumination module 110. The electrical energy, which may be received in the form of a time-varying periodic signal, for example, may be converted into light emitted by the illumination module 110. The illumination module 110 includes a LCF which filters modulations in the instantaneous conversion of light output by an illumination source 130 to yield a substantially reduced peak-to-peak ripple, for example, in the light intensity emitted by the light source assembly 100. In particular, the LCF may reduce the maximum amplitude of the illumination flux 137 intensity emitted by the light source assembly 100 (e.g., by reducing the amount of illumination flux 132, which is output by the illumination source 130, which is output from the light source when the AC excitation waveform is at or near a peak value), and may increase the minimum amplitude of the illumination flux 137 intensity emitted by the light source assembly 100 (e.g., when the illumination flux 132 output by the illumination source 140 reaches a minimum amplitude, such as when the AC excitation waveform is at or near a zero value).

In various embodiments, methods may include emitting an illumination flux 137 from the illumination module 110 with an intensity having a peak-to-peak ripple under about 30% responsive to an applied periodic electrical excitation having a frequency of less than about 200 Hertz (e.g., 45, 50, 55, 60, 65, 100 Hz). In an illustrative example, some examples may include providing an internal dose of illumination flux 132 within the illumination module 110, where the illumination flux intensity may be emitted in response to a periodic electrical excitation signal applied to the light source assembly 100. The illumination flux 132 may be used to charge a light capacitive filter (LCF), for example by providing a medium-persistence coating for absorbing a portion of the illumination flux 132. The LCF may gradually re-emit the absorbed light over a time period, characterized by a half-life, such that the light source continues to emit light (as illumination flux 137) even during periods in which the illumination flux 132 is null. In some examples, the LCF may be a light persistent filter configured to absorb light received from an illumination source 130, and the re-emit the light over a period of time (e.g., milliseconds, tens of milliseconds, or longer), so as to provide a light having extended persistence. In general, the period of time over which a majority of the light is re-emitted from the LCF (i.e., the half-life of the LCF) may be of at least 1 ms and less than 2 s.

In some exemplary embodiments, the time for the illumination flux 137 output by the illumination module 110 to decay to 70% of peak intensity ($T_{70}$) may be at least 25% of the period of the applied electrical excitation (e.g., at least 4.16 milliseconds (ms) in the case of a 60 Hz excitation signal). In other exemplary embodiments, the time for the illumination flux output by the LCF to decay to 70% of peak intensity output by the LCF may be at least 25% of the period of the applied electrical excitation.

In some exemplary embodiments, the time for the illumination flux 137 to decay to 25% of peak intensity ($T_{25}$) may be equal to or exceed a period of the applied electrical excitation (e.g., a 16.7 ms period in the case of a 60 Hz excitation signal), and may reach values of up to two seconds. Some examples may provide illumination having a beam pattern emitted from a light chamber, where the illumination has an intensity for which the $T_{70}$ time may be at least about one fourth of the period of the fundamental frequency of the electrical excitation waveform and the $T_{25}$ time may be under two seconds. Other examples may provide the $T_{25}$ time to be about 100, 200, 300, 400, 500, 600, 700, 800, 900 ms, or up to about one or two seconds. In an exemplary embodiment, the $T_{25}$ time is less than about 0.5 s and the $T_{70}$ time is at least 25% of the period of the sinusoidal electrical excitation (e.g., at least 5 ms for 50 Hz excitation).

The base module 105 includes a base 115 which houses electrical conduction paths (not shown) that convey electrical signals from an electrical input interface 120 to the illumination source 130 or illumination module 110. The base module 105 further includes, in the depicted example, a driver circuit module 125 configured to process signals received at the electrical input interface 120 and provide the processed signal to the illumination module 130. In the depicted example, the electrical input interface 120 has a threaded conductive surface for making electrical contact with a correspondingly threaded socket. In other embodiments, the electrical input interface 120 may have posts such as those used in GU-style lamps, or other types of contacts for receiving an electrical excitation signal.

By way of example, and not limitation, the driver circuit module 125 may include apparatus to process a received electrical excitation by filtering (e.g., low pass, notch filter), rectification (e.g., full wave, or half-wave rectification), current regulation, current limiting, power factor correction (PFC), resistive limiting, or a combination of these or similar waveform processing operations. In some embodiments, the driver circuit module 125 may include a current interruption element (e.g., fuse, positive temperature coefficient resistor) to control fault current events, a voltage magnitude scaler (e.g., transformer), and/or a potential limiter (e.g., transzorb, MOV). The driver circuit module 125 may receive through the input interface 120 a time varying, periodic electrical excitation signal with alternating polarity voltage, for example, and may produce a rectified version of the received signal for application to the illumination module 110. In some embodiments, the driver circuit module 125 may be a linear circuit suited to electromagnetically quiet operation. In some other embodiments, a modulated switching power converter may operate at, for example, between about 20 kHz and about 2 MHz, for example, as is conventional for converting sinusoidal AC (alternating current) to substantially regulated DC (direct current) for supply to the illumination module 110. In some embodiments, driver circuit module 125 may not include energy storage elements, such as capacitors and inductors, so as to maximize the power factor of the light source and minimize the harmonic distortion caused by the driver circuit module.

The illumination module 110 includes an illumination source 130 and a light chamber wall 135 defining an internal volume forming a light chamber when the wall 135 is attached to the base module 115, as shown in FIG. 1. The chamber wall may be a translucent or transparent wall, and may be formed of a glass, frosted or colored glass, plastic, frosted or colored plastic, or any other suitable material.

The illumination source 130 may be, for example, a LED (light emitting diode), that converts electrical excitation to a light output (shown as illumination flux 132) into the light chamber. In the case of a low persistence illumination source (e.g., persistence substantially less than 0.1 ms), such as a LED with a non-persistent or low-persistence phosphor, the light intensity output of the LED may typically respond to the applied electrical excitation waveform without substantial temporal delay. Accordingly, a time-varying electrical excitation applied to the illumination source may be converted by the LED (or by a network of a plurality of LEDs, for example) to a corresponding time-varying light intensity. In various embodiments, the illumination source 130 may emit a primary light flux (PLF1, illustratively shown at 132) that is received by a light capacitive filter (LCF) in the light path.

As will be described with reference to FIGS. 5A-5F, the LCF may be disposed locally with respect to the illumination source 130 (e.g., as a coating or layer applied directly to illumination source 130), and/or remotely with respect to the illumination source 130 (e.g., as a coating or layer applied to a surface of chamber wall 135). In some examples, the LCF may be disposed as a layer of LC material (e.g., a medium-persistence phosphor) locally on the LED dies in the illumination source 130. In such embodiments, the flux emitted into the light chamber may have a substantially attenuated peak-to-peak variation in intensity in response to a time-varying electrical excitation signal, such as a rectified 50 or 60 Hz voltage sine wave, for example. A medium-persistence phosphor may be a phosphor having a decay time (or decay half-life) that is longer than approximately 1 ms, and shorter than approximately 1 minute. A long persistence phosphor may be a phosphor having a decay time substantially longer than 10 minutes.

In some implementations, the LC filter may substantially reduce light intensity modulation associated with a light source operated at low excitation frequencies (e.g., about 50 Hz, 60 Hz, 70 Hz, . . . , 100 Hz, 120 Hz, . . . , 400 Hz) from a periodic or time-varying excitation amplitude.

Figure 2:
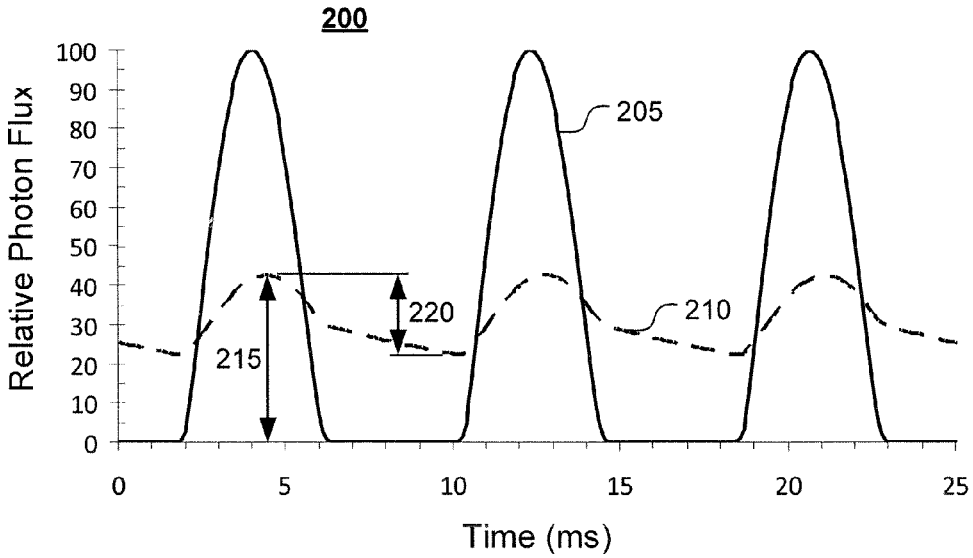
FIG. 2 shows an exemplary plot of light modulation intensity produced by an light source excited by a time-varying waveform.

FIG. 2 is an exemplary plot 200 of light modulation intensity produced by light source 100, illumination module 110, and/or illumination source 130 when excited by a time-varying full-wave rectified sinusoidal waveform. As depicted, plot 200 includes an exemplary electrical excitation plot 205 and an exemplary output light intensity plot 210. As shown, the electrical excitation plot 205 corresponds to a full-wave rectified sine waveform, which may correspond to the electrical waveform received by illumination source 130 of FIG. 1. The electrical excitation plot 205 may be plotted as a voltage, current, or energy (in units of volts, amperes, or watts on the y-axis) with respect to time (on the x-axis).

In response to receiving the full-wave rectified sine waveform, the illumination module 110 may produce an output illumination flux 137. In embodiments in which no LCF is present, the light intensity output by the illumination source 130 and the illumination module 100 may vary with a profile substantially similar to excitation plot 205. However, in embodiments in which the illumination module 110 includes a LCF, the illumination module may produce an output illumination flux 137 corresponding to variable light intensity plot 210. The light intensity is plotted in FIG. 2 as light intensity (on the y-axis) with respect to time (on the x-axis). At the peak intensity of the plot 210, the light intensity has a peak intensity value 215. Between peaks of the light intensity 210, the light intensity plot 210 decays to a minimum value as shown. The peak-to-peak swing in light intensity is depicted as an intensity ripple having an amplitude 220. The peak-to-peak swing in light intensity may be measured as the difference between the maximum (or peak) intensity value 215 and the minimum intensity value reached by the light intensity in each cycle. In various embodiments a ratio of the amplitude 220 to the peak intensity value 215 for a periodic electrical excitation may be about 30%, 29%, 28%, 27%, 26%, 25%, 24%, 23%, 22%, 21%, 20%, 19%, 18%, 17%, 16%, 15%, 14%, 13%, 12%, 11%, 10%, 9%, 8%, 7%, 6%, 5%, 4%, 3%, 2%, 1%, 0.5%, or about 0.1%.

For instance, some preferred examples may permit human-perceivable smooth turn-off performance in response to a light switch, for example, where the ratio may be selected to be in the range of, for example, 30% to 1%, or between about 26% and 3%, or 24% and 10%, or between about 20% and 14%.

Figure 3:
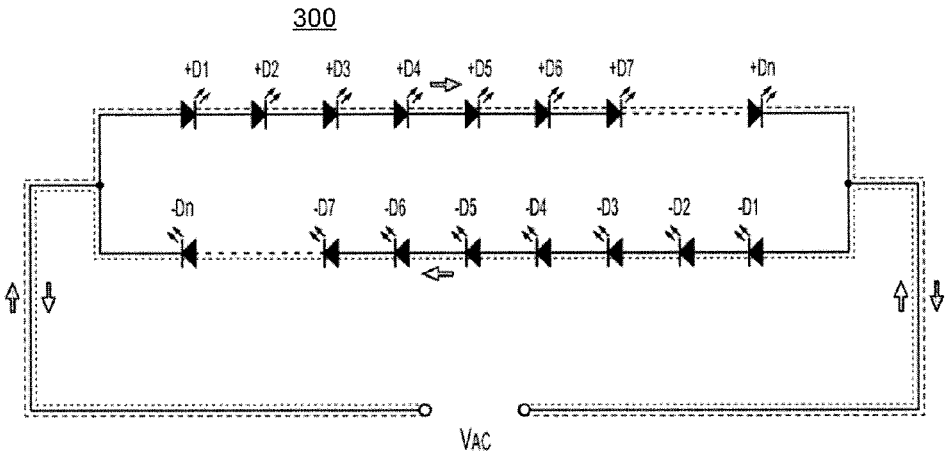
FIG. 3 shows an exemplary circuit configured to convert a time-varying waveform into light output.

FIG. 3 shows an exemplary circuit 300 configured to convert a time-varying waveform $V_{AC}$ into light output. The circuit 300 corresponds to an AC LED lighting apparatus that includes two strings of LEDs configured as a half-wave rectifier in which each LED string conducts and illuminates on alternating half cycles. In particular, a first group of LEDs (including LEDs +D1 to +Dn) conducts current during a first half of each cycle (e.g., during intervals Q1 and Q2 of the cycle), and a second group of LEDs (including LEDs −D1 to −Dn) conducts current during the second half of each cycle (e.g., during intervals Q3 and Q4 of the cycle). In either case (first or second half of the cycle), the AC input voltage may have to reach a threshold excitation voltage corresponding to a corresponding conduction angle in order for LEDs to start conducting significant currents and emit light, as discussed with reference to FIG. 4. In particular, the AC input voltage may have to reach a threshold excitation voltage equal to the sum of the forward bias voltages of the LEDs that are configured to operate during the half cycle in order for the LEDs to start conducting current and to emit light.

Examples of such an AC LED circuit are described with reference, for example, to at least FIG. 10 of U.S. patent application Ser. No. 12/785,498 (hereinafter, the '498 application), entitled "Reduction of Harmonic Distortion for LED Loads," filed April 24 May 2010, the entire contents of which are incorporated herein by reference. Additional exemplary circuits for achieving, for example, improved power factor and/or reduced harmonic distortion are described with reference to at least FIGS. 20-43 of the '498 application.

Figure 4:
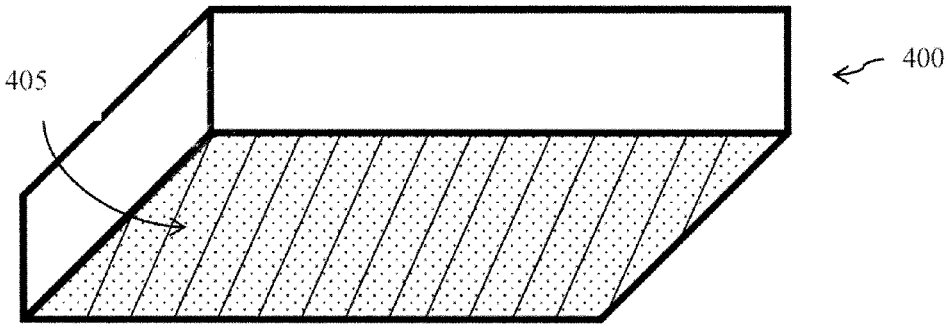
FIG. 4 shows an exemplary light fixture including a light capacitive filter on a chamber wall.

FIG. 4 shows an exemplary light fixture 400, such as troffer downlight fixture, including a LCF for providing a medium-persistence light source. The fixture 400 includes a LCF such as a medium-persistence phosphor on a light chamber wall taking the form of a rectangular flat window 405. As depicted, the troffer fixture 400 serves as a downlight through a rectangular window 405. The troffer fixture 400 may include an illumination source (not shown), located in a light chamber inside the fixture 400 such that light produced by the source is emitted from thw fixture through window 405. All or substantially all of the light emitted by the fixture 400 may be emitted through translucent or transparent window 405. The light source may be a light source such as the source circuit 300 described with reference to FIG. 3. The light emitted by the source may be filtered through the LCF on window 405, such that a medium-persistence phosphor (or other LCF) modulates the light emitted by the source to provide a medium-persistence source of light having reduced flicker.

The window 405 of fixture 400 is generally coated with a LCF coating which releases photons during portions of a period of the electrical excitation when light intensity output from the illumination source 130 is decreasing (such as those portions of the period during which the output of the illumination source 130 has a negative slope) or null, for example. Accordingly flicker and other modulations in emitted light intensity may be advantageously reduced or mitigated, notably in situations in which an illumination source with spatially separated light strings is distributed within the area of the troffer 400. When configured as a conventional series resistance LED load excited directly from utility line voltage (e.g., 120 V, or 240 V) this arrangement of the fixture 400 may yield a substantially flicker free light output with a low parts count AC LED apparatus.

FIGS. 5A-5H show exemplary configurations of light capacitive filters (LCFs), such as filters including a medium-persistence phosphor. In the exemplary configurations, an additional filter or coating, for example one formed of a different phosphor than the LCF, may be included as a remote and a local layer with respect to an illuminating source.

Figure 5A:
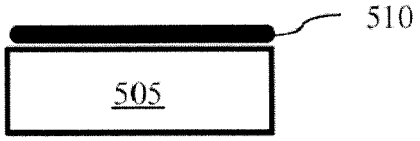
FIGS. 5A-5H show exemplary configurations of light capacitive filters with respect to an illuminating source.

FIG. 5A depicts an exemplary LED die 505 overlaid with a layer of a LCF coating 510. In this arrangement, the LCF coating 510 may be applied directly (or substantially directly) to the LED die 505, and is referred to herein as a local LCF coating or phosphor. For example, the LCF coating 510 may be coating that is applied directly to a surface of the LED 505 or a surface of a LED die.

Figure 5B:
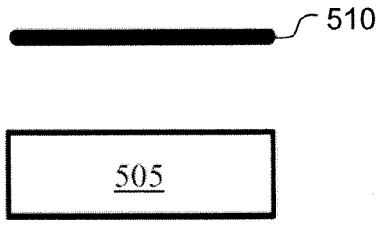

FIG. 5B depicts the exemplary LED die 505 overlaid with a layer of a LCF coating 510 disposed at a distance from the die 505. In this arrangement, the LCF coating 510 may be applied, for example, to a surface of a light chamber wall 135 or to a window 405 that is spaced away from the die 505 (e.g., at a distance of several millimeters or several centimeters), and the LCF coating 510 can thus be referred to as a remote LCF coating or phosphor.

Figure 5C:
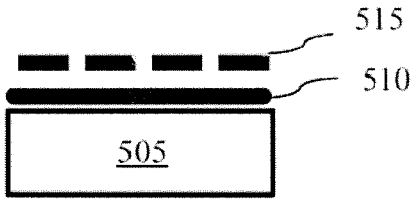

FIG. 5C depicts the exemplary LED die 505 overlaid with a local layer of a LCF coating 510 and a local layer of a second phosphor 515. The layer of second phosphor 515 is generally formed of a material that is different from the coating 510; however, in some examples, the same material may be used for both coatings. In the arrangement shown, the LCF coating 510 and second phosphor 515 are respectively referred to herein as a local LCF coating or phosphor and a local second coating or phosphor.

Figure 5D:
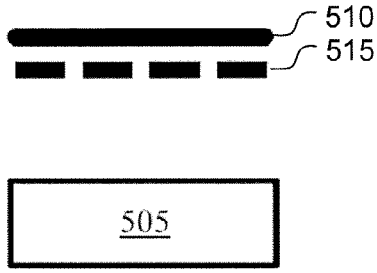

FIG. 5D depicts the exemplary LED die 505 overlaid with a remote layer of a LCF coating 510 and a remote layer of a second phosphor 515. The layer of second phosphor 515 is generally formed of a material that is different from the coating 510; however, in some examples, the same material may be used for both coatings. In the arrangement shown, the LCF coating 510 is referred to herein as a remote LCF coating or phosphor. An example of this embodiment could be implemented as two coats, a remote LCF coat 510 and the remote regular coat 515, applied on a surface of the window 405 of FIG. 4, or of the light chamber wall 135 of FIG. 1.

Figure 5E:
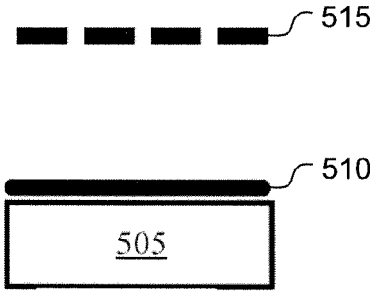

FIG. 5E depicts the exemplary LED die 505 overlaid with a local layer of the LCF coating 510, and a remote layer of the second phosphor 515. The layer of second phosphor 515 is generally formed of a material that is different from the coating 510; however, in some examples, the same material may be used for both coatings.

Figure 5F:
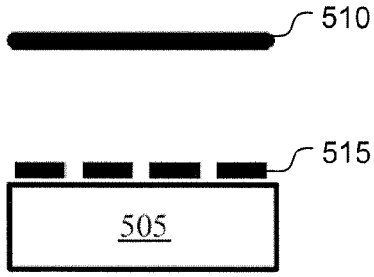

FIG. 5F depicts the exemplary LED die 505 overlaid with a local layer of the second phosphor 515 and a remote layer of the LCF coating 510. The layer of second phosphor 515 is generally formed of a material that is different from the coating 510; however, in some examples, the same material may be used for both coatings.

Figure 5G:
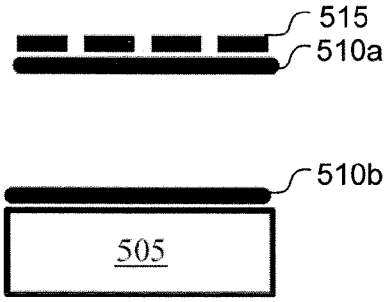

FIG. 5G depicts the exemplary LED die 505 overlaid with a local layer of the LCF coating 510 and a remote layer of the second phosphor 515 and an additional remote layer of the LCF coating 510. The layer of second phosphor 515 is generally formed of a material that is different from the coating 510; however, in some examples, the same material may be used for both coatings.

Figure 5H:
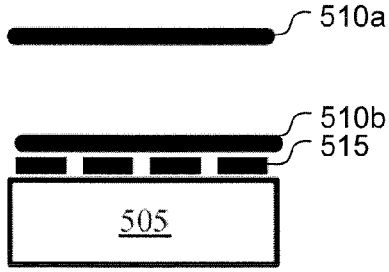

FIG. 5H depicts the exemplary LED die 505 overlaid with a local layer of the second phosphor 515, an additional local layer of the LCF coating 510, and a remote layer of the LCF coating 510. The layer of second phosphor 515 is generally formed of a material that is different from the coating 510; however, in some examples, the same material may be used for both coatings.

In various embodiments, the die 505 may be, for example, a blue, near-UV, or UV (ultraviolet) LED. The higher energy blue spectrum may, in some embodiments, advantageously achieve improved efficacy with commercially available phosphors to produce a white or high color rendering index (CRI) output.

In various embodiments, the LCF is a coating 510 that is translucent or transparent. The LCF 510 may include a medium-persistence phosphor, or a mixture of different types of phosphors. Phosphors and other materials used to form the LCF 510 may be selected so as to re-emit a light having a particular color, so as to re-emit light with a particular decay constant or half-life, or based on other criteria. In general, a LCF 510 may include a medium persistence phosphor, such as a SrAl2O4:Eu2+,Dy3+ phosphor (a green phosphor).

In some implementations the second phosphor may be a commercially available phosphor for producing a white color spectrum. For example, the second phosphor material may include conventional YAG (Yttrium aluminum garnet), RG (red green), or RY (red-yellow) phosphors. The second phosphor may emit light having the same or a different color from the light emitted by the LCF.

Figure 6:
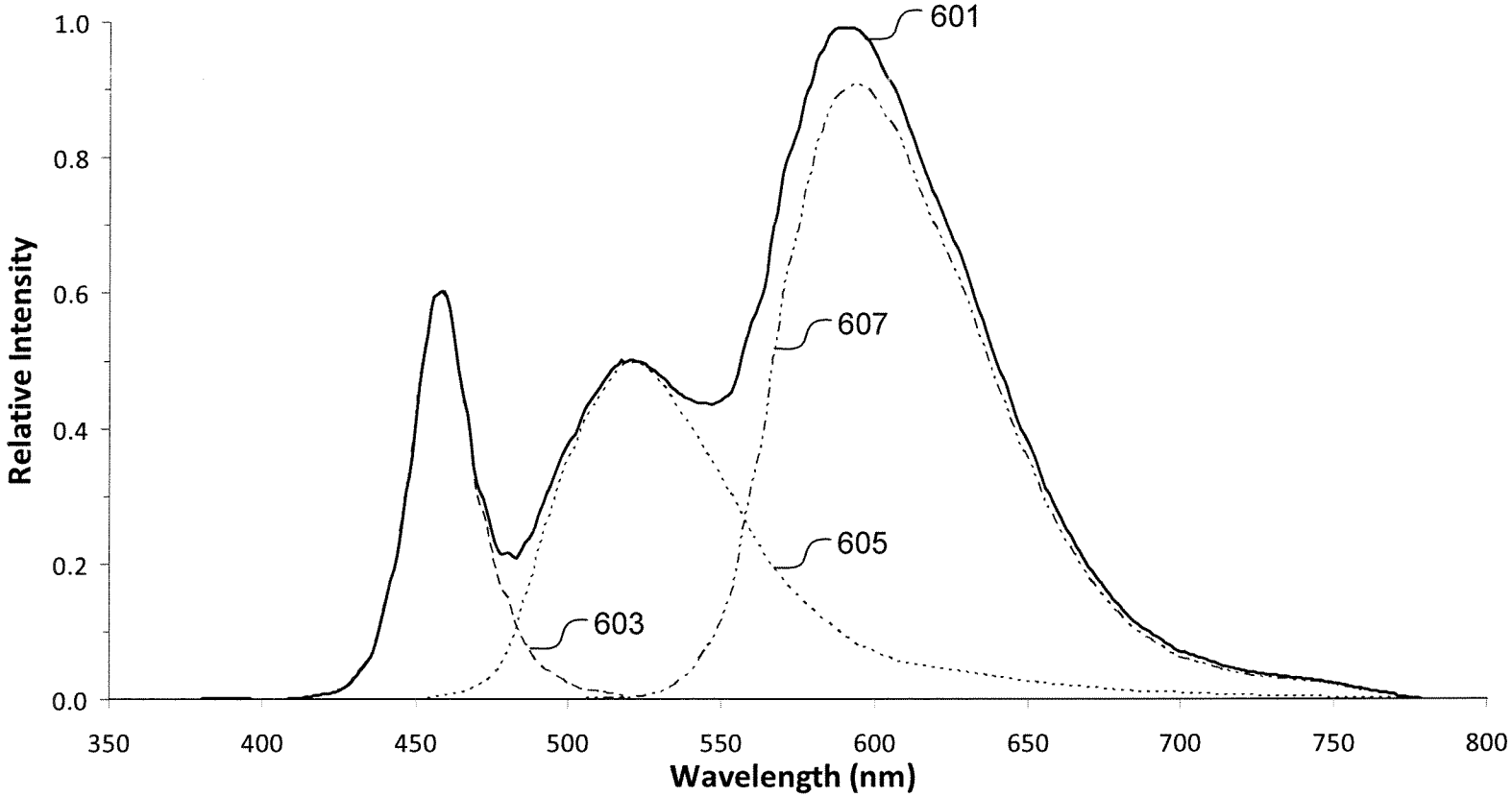
FIG. 6 shows a plot of the relative intensity of wavelengths emitted by different types or combinations of phosphors or other light sources.

FIG. 6 shows a plot of the relative intensity of wavelengths emitted by different types or combinations of phosphors. A first trace 603 shows the relative intensity of wavelengths emitted by a blue LED which exhibits a peak of relative intensity at approximately 450 nm wavelengths. A second trace 605 shows the relative intensity of wavelengths emitted by a SrAl2O4:Eu2+ phosphor which exhibits a peak at approximately 525 nm wavelengths. A third trace 607 shows the relative intensity of wavelengths emitted by a phosphor having a composition of (SrS:0.1% Eu2+. 0.05% Al3+, 0.1% Ce3+) and which exhibits a peak at approximately 600 nm wavelengths. Finally, a fourth trace 601 shows the relatively intensity of wavelengths emitted by a combination of light source combining a blue LED, a SrAl2O4:Eu2+ phosphor, and a (SrS:0.1% Eu2+, 0.05% Al3+, 0.1% Ce3+) phosphor. The light output according to the fourth trace 601 includes a broad range of wavelengths, and may appear to be white in color.

More generally, phosphors emitting different ranges of wavelengths may be combined in a LCF, so as to adjustably control the wavelength composition and resulting color of light emitted (or re-emitted) by the LCF. Alternatively or additionally, a LCF may be combined with a second coating (such as coating 515 of FIGS. 5C-5H) to control the wavelength composition and resulting color of light emitted by an illumination module including a LCF and a second coating. The second coating may be composed of one or more short-persistence phosphors, medium-persistence or other types of phosphors, fluorescent dyes, and/or photo-luminescent dyes, or the like.

For example, the LCF may include or be formed of a medium persistency phosphor such as SrAl2O4:Eu2+,Dy3+ which emits a green light (or greenish light). The LCF may be used in combination with a second coating such as another medium persistency phosphor such as SrS:Eu2+:Al3:Ce3+, such that the combination of the two phosphors causes a generally white light to be emitted (e.g., a light having a similar color rendering index (CRI), color temperature, and wavelength composition as light output when a non-persistent YAG:Ce phosphor is used).

The combination of materials used in the LCF and the second coating may additionally be selected so as to provide good lighting efficiency. In general, an efficiency metric can be calculated as a ratio of total flux emitted by an LCF (or other light filter) to the total flux absorbed by the LCF (or received by the other light filter). While green medium persistency phosphors (such as SrAl2O4:Eu2+, Dy3+) generally have good efficiency, many phosphors emitting red light have low efficiency (such as SrS:Eu2+:Al3:Ce3+). Thus, instead of using a low-efficiency phosphor to emit red light which, in combination with a phosphor emitting green light, would produce a white light, a second coating can be used to correct the color of the phosphor emitting green light. The second coating need not be a medium or long persistency phosphor. For example, an LCF emitting any color of light (e.g., a SrAl2O4:Eu2+, Dy3+ phosphor having good efficiency) may be used in combination with a second coating 515 used to filter the light, such that the light output by the illumination module is white (or any other desired color). The second coating 515 may thus serve as a color conversion layer, and can be formed for example of a fluorescent or photo luminescent dye.

Figure 7A:
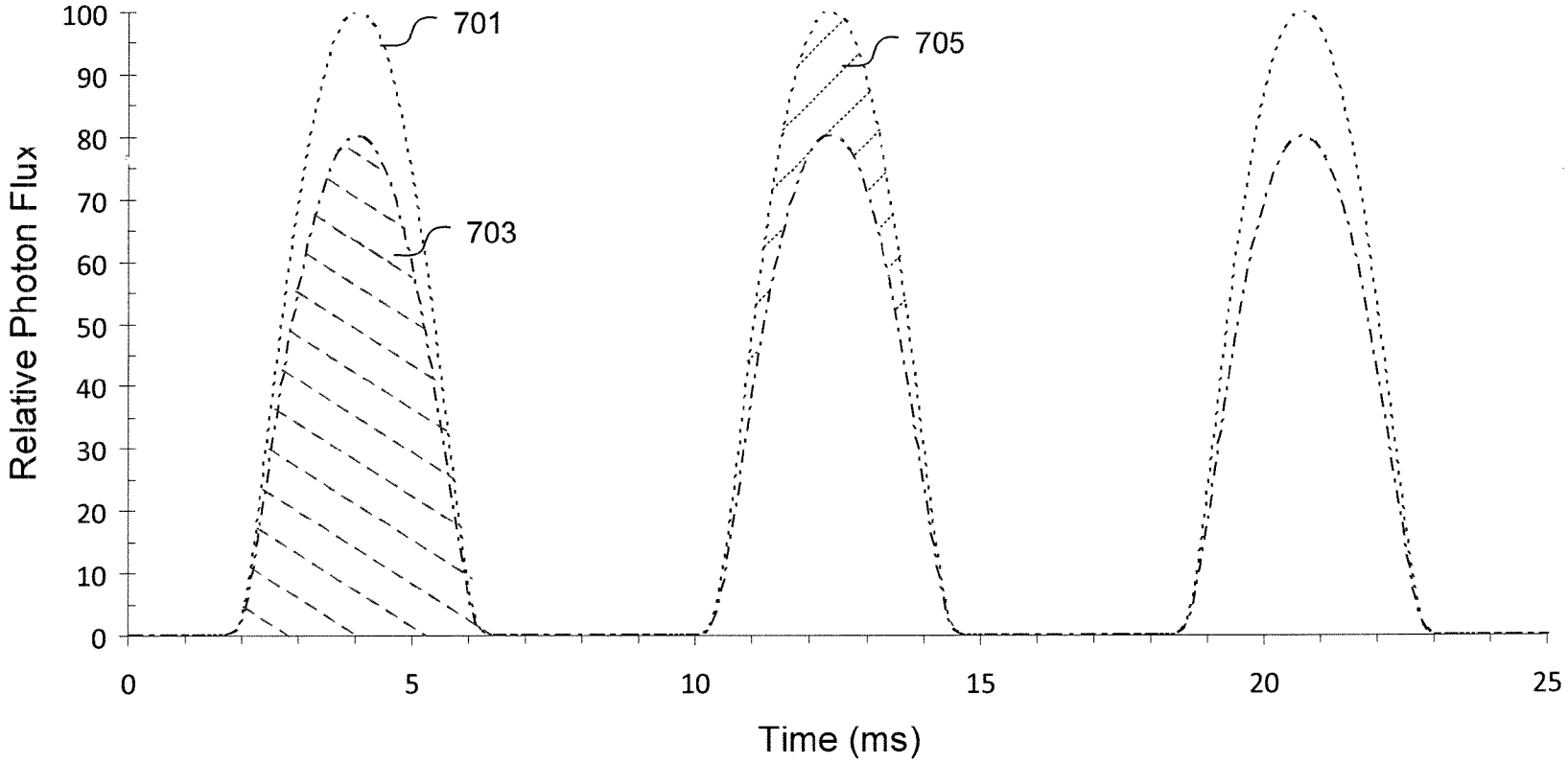
FIGS. 7A-7C show illustrative plots of photon flux produced in and emitted from a light source including a light capacitive filter.
Figure 7B:
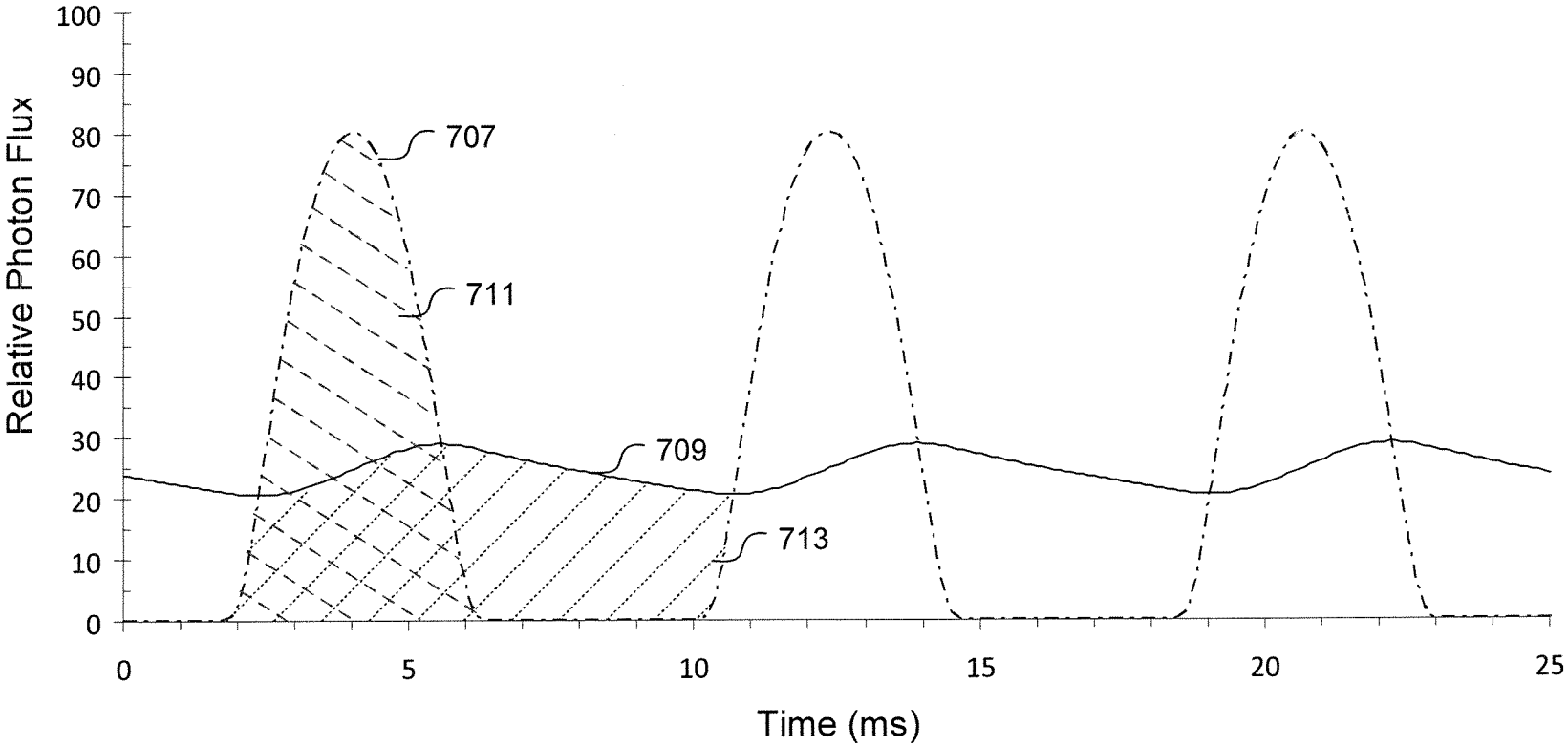
Figure 7C:
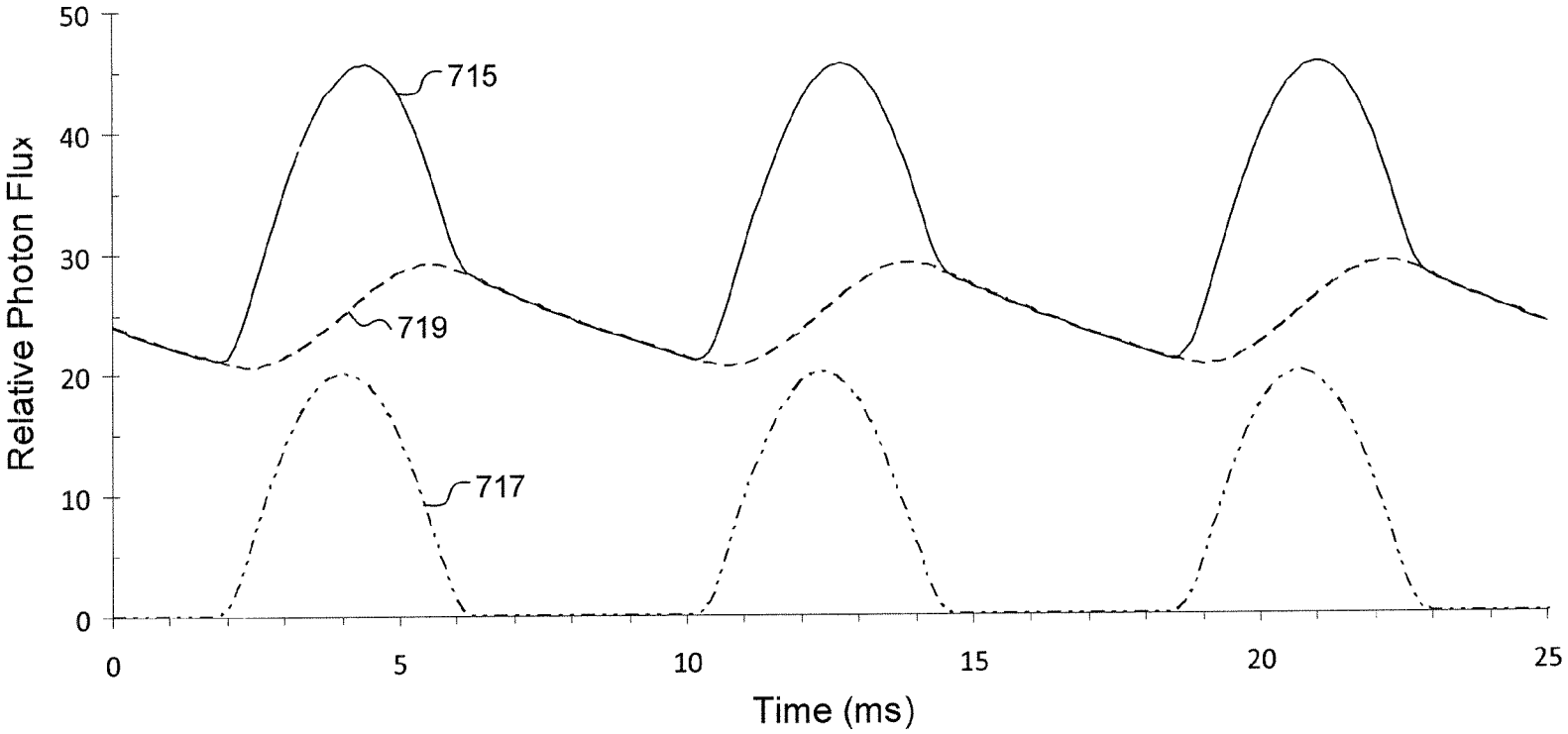

FIGS. 7A-7C show illustrative plots of photon flux in a light source assembly, such as assembly 100, having a LCF disposed in the illumination path. The plots show photon flux produced in response to an exemplary half-wave rectified sinusoidal waveform.

FIG. 7A shows the total photon flux 701 emitted by the illumination source 130 in response to the half-wave rectified sinusoidal waveform, as a function of time. The total photon flux 701 may correspond to the total photon flux emitted by a LED die included as an illumination source 130, for example, and provides a measure of the illumination intensity or light intensity emitted by the source. The plot of total photon flux 701 may provide an indication of the illumination flux produced by illumination source 130 and illustratively shown at 132 in FIG. 1, for example. In an assembly such as assembly 100, a portion of the illumination flux emitted by the illumination source 130 is absorbed by the LCF such as the LCF applied to the chamber wall 135. The portion of the total photon flux 701 that is absorbed by the LCF is illustratively shown as the hashed area 703 in FIG. 7A. The absorbed photon flux may correspond to photon flux that is emitted by the illumination source 130, but is not directly emitted from the illumination module 110 or light source assembly 100. Instead, the absorbed photon flux is absorbed by the LCF, and re-emitted from the LCF at a later time. The remaining portion of the total photon flux 701 that is not absorbed by the LCF corresponds to transmitted flux, and is illustratively shown as the hashed area 705 in FIG. 7A. The transmitted photon flux may correspond to photon flux that is emitted by the illumination source 130, passes through the LCF without being absorbed by the LCF, and is thus directly emitted from the light source assembly 100 substantially concurrently with the time the flux is emitted by the illumination source 130.

FIG. 7B shows the absorbed photon flux 707 absorbed by the LCF in response to the half-wave rectified sinusoidal waveform, as a function of time. The figure also shows the emitted photon flux 709 emitted by the LCF, in response to the LCF absorbing the photon flux 707 and re-emitting the absorbed photon flux 707. As shown in the figure, the absorbed photon flux is re-emitted from the LCF over time, such that absorbed photon flux is re-emitted a variable time after it has been absorbed. The variable time may be adjustable or selectable based on the composition of the LCF, and may be characterized by an average decay time (or decay half-life) after which the flux is re-emitted. The half-life is a measure of the time after which half of the illumination energy or photon flux that will be re-emitted from the LCF has been re-emitted by the LCF. The LCF may also be characterized by an efficiency metric calculated as the ratio of the total flux emitted by the LCF to the total flux absorbed by the LCF. The efficiency may thus be a measure of the portion of absorbed flux (and corresponding illumination energy) that is re-emitted, and in the example shown in FIG. 7B, may be calculated based on the ratio of the total area under the curve 709 during one cycle (shown as hashed area 713 in the figure) to the total area under the curve 707 during one cycle (shown as hashed area 711 in the figure).

FIG, 7C shows the total photon flux 715 output by the light source assembly 100. The total photon flux 715 may correspond to the sum of the transmitted photon flux 717 (corresponding to the transmitted photon flux shown at 705) and the re-emitted photon flux 719 (corresponding to the emitted photon flux shown at 709).

In the example shown in FIGS. 7A-7C, the flicker or modulation of the lighting intensity produced by the illumination module 110 is reduced with respect to that output by the illumination source 130. In particular, the photon flux output by the illumination source 130 varies in each cycle between 0% and 100%, as shown in FIG. 7A, corresponding to 100% modulation, percent flicker, or ripple intensity. In contrast, the photon flux output by the illumination module 110 varies in each cycle between 0% and 45%, as shown in FIG. 7C, corresponding to a modulation, percent flicker, or ripple intensity of: Percent flicker=(Max−Min)/(Max+Min)=0.25/0.65=38%. Alternatively, the flicker or modulation can be measured using a measure of flicker index, defined as the ratio of the area under the illumination flux curve that is above the average illumination flux, divided by the total area under the illumination flux curve, during one cycle.

Although various embodiments have been described with reference to the figures, other embodiments are possible. For example, apparatus and methods may involve time-varying unipolar excitation signals. As examples, excitation signal waveforms may resemble triangular, rectangular, square, or rectified sine waveforms.

Other embodiments may operate from time-varying alternating polarity signals. Examples of time-varying alternating polarity waveforms may include utility quality substantially sinusoidal voltage waveforms at about 50 or 60 Hertz, for example.

In various exemplary embodiments, a LCF phosphor may retain a displayed image for a period of time substantially longer than a single period of the electrical excitation waveform.

In some embodiments, the LCF may be formed of a persistence phosphor, such as a phosphor commercially available from Stanford Materials of California. The phosphor may be deposited onto a LED die surface (local) or a remote surface in the light chamber in one of several ways. For example, the LCF phosphor may be applied as dots. In some examples, the dots may be placed interstitially among lines of a conventional (e.g., YAG) phosphor deposited on the same surface in a linear or gridded pattern, for example. In some other embodiments, the LCF phosphor may be deposited in a substantially continuous film layer substantially covering a surface area of the die, chamber wall, or window.

In accordance with another embodiment, photo-luminescent material coatings, such as those commercially available from Performance Indicator, LLC of Massachusetts, may provide a second flux light output during intervals between peaks of the periodic electrical excitation, for example.

Thus, apparatus and associated methods have been described for emitting an illumination flux external to a light chamber with a peak-to-peak ripple intensity under about 30% responsive to an applied periodic electrical excitation having a fundamental frequency of between about 50 Hz and about 200 Hz. In an illustrative example, some embodiments may include providing an internal dose of light flux responsive to the applied periodic electrical excitation.

Various embodiments may achieve one or more advantages. For example, some embodiments may advantageously significantly reduce or substantially eliminate perceivable flicker-related phenomena associated with light intensity modulation. Some implementations may substantially mitigate stroboscopic effects for illumination from LED (light emitting diode) light sources excited by electrical excitation at about 50 Hz or about 60 Hz, for example. Some implementations may provide for a visually pleasant extended transition time in light intensity in response to operation of a switch configured to interrupt or connect a light source to a source of electrical excitation. Some implementations may leverage reduced light intensity modulation to reduce the parts count and cost while increasing electrical efficiency, for example, by eliminating a rectification stage and operating a LED light string product without the rectifier.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. For example, advantageous results may be achieved if the steps of the disclosed techniques were performed in a different sequence, or if components of the disclosed systems were combined in a different manner, or if the components were supplemented with other components. Accordingly, other implementations are contemplated. It is intended by the following claims to claim any and all applications, modifications and variations that fall within the true scope of the present teachings.

What is claimed is:

1. An illumination module for providing reduced flicker illumination, the illumination module comprising:

an illumination source for converting periodic electrical excitation into emitted light having at least one light emitting diode die, wherein the emitted light has a first percent flicker;

a light capacitive filter overlaying a surface of the at least one light emitting diode die as a coating for filtering the light emitted by the illumination source as a first flux light output to produce a reduced flicker illumination; and a photo luminescent material coating remote from the light capacitive filter and providing a second flux light output during intervals between peaks of the periodic electrical excitation, wherein the reduced flicker illumination has a percent flicker that is lower than the first percent flicker.

2. The illumination module of claim 1, wherein the light capacitive filter absorbs light emitted by the illumination source, and re-emits the absorbed light during a period of time following the absorption.

3. The illumination module of claim 2, wherein the light capacitive filter is a coating of a light persistent phosphor.

4. The illumination module of claim 3, wherein the light capacitive filter is a coating of the light persistent phosphor having the composition SrAl204:Eu2+, Dy3+.

5. The illumination module of claim 2, wherein the light capacitive filter re-emits the absorbed light with a half-life of between 1 millisecond and 2 seconds.

6. The illumination module of claim 1, further comprising:

a second coating for filtering at least one of the light emitted by the illumination source and the illumination produced by the light capacitive filter, wherein the second coating filters light to have a different color as compared to the light produced by the light capacitive filter.

7. The illumination module of claim 6, wherein the second coating is formed of at least one of a medium persistence phosphor, a low persistence phosphor, a fluorescent dye, and a photo-luminescent dye.

8. The illumination module of claim 1, further comprising:

a phosphor coating, wherein the second phosphor coating produces light having a different color as compared to the light produced by the light capacitive coating.

* * * * *